US007181939B2

(12) United States Patent
Andersen

(10) Patent No.: US 7,181,939 B2
(45) Date of Patent: Feb. 27, 2007

(54) KEY ASSEMBLY

(76) Inventor: Mike T. Andersen, 1014 Oak La., Van Wert, OH (US) 82762

( * ) Notice: Subject to any disclaimer, the term of this patent is extended or adjusted under 35 U.S.C. 154(b) by 0 days.

(21) Appl. No.: 10/915,859

(22) Filed: Aug. 11, 2004

(65) Prior Publication Data

US 2006/0032279 A1 Feb. 16, 2006

(51) Int. Cl.
*E05B 19/02* (2006.01)
*E05B 19/26* (2006.01)

(52) U.S. Cl. ..... 70/395; 70/404; 70/408; 70/413; 70/459

(58) Field of Classification Search ..... 70/395, 70/408, 276, 413, 16, 456 R, 459, 460, 400, 70/403, 404; 24/66.1, 303
See application file for complete search history.

(56) References Cited

U.S. PATENT DOCUMENTS

| | | | | | |
|---|---|---|---|---|---|
| 2,634,600 | A | | 4/1953 | Seely | |
| 2,975,497 | A | | 3/1961 | Budreck | |
| 3,007,568 | A | | 11/1961 | Kurland | |
| 3,041,697 | A | | 7/1962 | Budreck | |
| 3,069,890 | A | | 12/1962 | McKinney et al. | |
| 3,111,736 | A | * | 11/1963 | Budreck | 24/303 |
| 3,141,214 | A | | 7/1964 | Bey | |
| 3,212,546 | A | | 10/1965 | Lind | |
| 3,277,681 | A | | 10/1966 | Bey | |
| 3,349,589 | A | * | 10/1967 | Fricke | 70/395 |
| 3,602,020 | A | * | 8/1971 | Kajita | 70/276 |
| 3,621,690 | A | | 11/1971 | Whitcomb | |
| 3,680,338 | A | * | 8/1972 | Lee | 70/456 R |
| 3,729,965 | A | * | 5/1973 | Gartner | 70/395 |
| 3,813,907 | A | | 6/1974 | Jones, Jr. et al. | |
| 3,837,195 | A | * | 9/1974 | Pelto | 70/276 |
| 3,841,120 | A | * | 10/1974 | Gartner | 70/395 |
| 3,942,345 | A | * | 3/1976 | Sasahara | 70/276 |
| 3,952,563 | A | * | 4/1976 | Yamashita | 70/232 |
| 3,961,507 | A | | 6/1976 | Falk | |
| 4,112,820 | A | | 9/1978 | Conger et al. | |
| 4,416,127 | A | * | 11/1983 | Gomez-Olea Naveda | 70/276 |
| 4,432,219 | A | | 2/1984 | Bassett | |
| 4,457,425 | A | | 7/1984 | Cooper et al. | |
| 4,838,060 | A | | 6/1989 | Hutzenlaub | |
| 4,841,758 | A | * | 6/1989 | Ramblier | 70/276 |
| 4,901,405 | A | * | 2/1990 | Grover et al. | 24/303 |
| 5,050,276 | A | | 9/1991 | Pemberton | |
| 5,099,659 | A | | 3/1992 | Carranza et al. | |
| 5,174,140 | A | | 12/1992 | Lee | |
| 5,197,168 | A | | 3/1993 | Levy | |
| 5,245,143 | A | | 9/1993 | James et al. | |
| 5,339,659 | A | * | 8/1994 | Guzzinati | 70/120 |
| 5,402,660 | A | | 4/1995 | Osada | |
| 5,485,733 | A | | 1/1996 | Hoffman | |

(Continued)

FOREIGN PATENT DOCUMENTS

JP 10131562 A 5/1998

*Primary Examiner*—Lloyd A. Gall
(74) *Attorney, Agent, or Firm*—Barnes & Thornburg LLP

(57) ABSTRACT

A key assembly includes a key, a cap and a fastener to selectively secure the cap to the key. The cap may include an opening for receiving a key ring, or other structure, therethrough. In one embodiment, the key includes a grip, and the cap and grip cooperate to enclose the key when the cap is secured in place.

17 Claims, 2 Drawing Sheets

U.S. PATENT DOCUMENTS 5,544,512 A 8/1996 Shieh
5,548,984 A 8/1996 Miyatsu
5,664,449 A 9/1997 Sedley
5,735,152 A 4/1998 Dietz et al.
5,927,116 A * 7/1999 Emoff ..... 70/456 R
6,038,898 A 3/2000 Cliff
6,041,628 A 3/2000 Lin
6,082,160 A * 7/2000 Martyniak ..... 70/431
6,189,347 B1 * 2/2001 Thompson ..... 70/16
6,209,370 B1 4/2001 Larson et al.
6,272,891 B1 * 8/2001 Moen ..... 70/428
6,523,380 B1 2/2003 McGuire
6,561,000 B2 5/2003 Tallarico
6,640,398 B2 11/2003 Hoffman
6,672,118 B1 * 1/2004 Wright ..... 70/459
6,679,828 B2 1/2004 Kaufman et al.
6,848,288 B1 * 2/2005 Derman ..... 70/459
6,981,391 B2 * 1/2006 Suzuki ..... 63/3.1
2004/0003635 A1 1/2004 Wright
2004/0154143 A1 8/2004 Harrell

* cited by examiner

KEY ASSEMBLY

TECHNICAL FIELD

The present invention relates generally to key assemblies. More specifically, the invention relates to a key assembly, which includes a key and a cap secured to the key.

BACKGROUND

Several devices have been developed for retaining or securing keys. Well known methods such as key rings have been apparent for some time. Some key rings include selective coupling with other rings, allowing a key(s) to be easily disconnected from a group of keys. Other key rings, however, require a more difficult disconnect process from the key ring.

SUMMARY

The invention allows a key to be selectively fastened to a cap or other body. For example, in one illustrative embodiment the cap is secured to a key ring, thus allowing the key to be unfastened from the key ring and cap while in use. The key may then be again re-fastened to the cap and secured there until further use. In another illustrative embodiment of the key assembly, the key can include a grip for removing the key from the cap and for turning the key if needed. The cap and grip can be formed to enclose the key when the key is fastened to the cap.

In another illustrative embodiment, the cap and grip each include a magnet. The magnets interact, thereby fastening the cap and grip to one another. Alternatively, the key can be formed of ferromagnetic material to fasten the key to the cap. It is appreciated that other fastener-types may be used to fasten the cap to the key or grip, such as a clasp or leaf-spring, for example. The key and cap can be interlocking for fastening the key and cap to one another.

Additional embodiments, features and advantages will become apparent to those skilled in the art upon consideration of the following description of the illustrated embodiment exemplifying the best mode of carrying out the invention.

BRIEF DESCRIPTION OF DRAWINGS

The present invention will be described hereafter with reference to the attached drawings which are given as non-limiting examples only, in which.

Corresponding reference characters indicate corresponding parts throughout the several views. The exemplification set out herein illustrates embodiments of the key assembly, and such exemplification is not to be construed as limiting the scope of the key assembly in any manner.

DETAILED DESCRIPTION OF THE DRAWINGS

Figure 1:
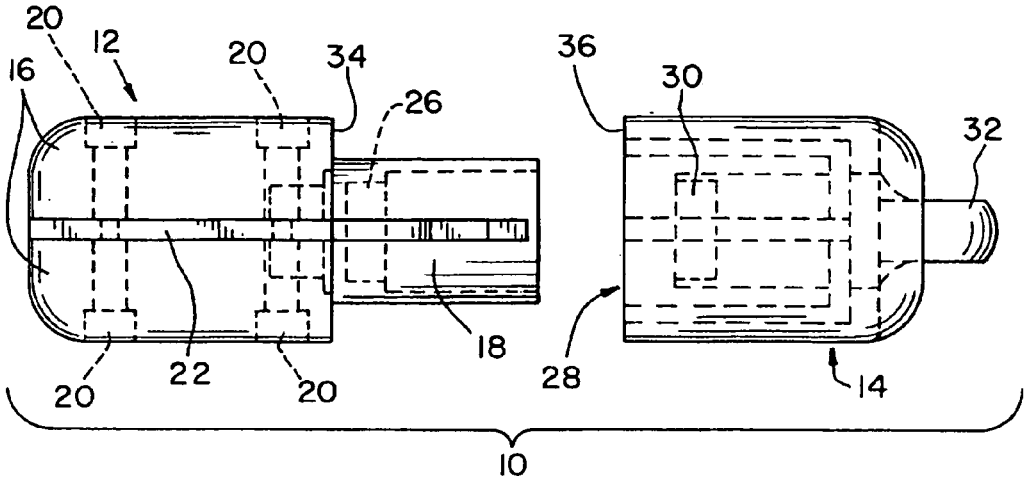
FIG. 1 illustratively shows a side view of a key assembly.
Figure 3:
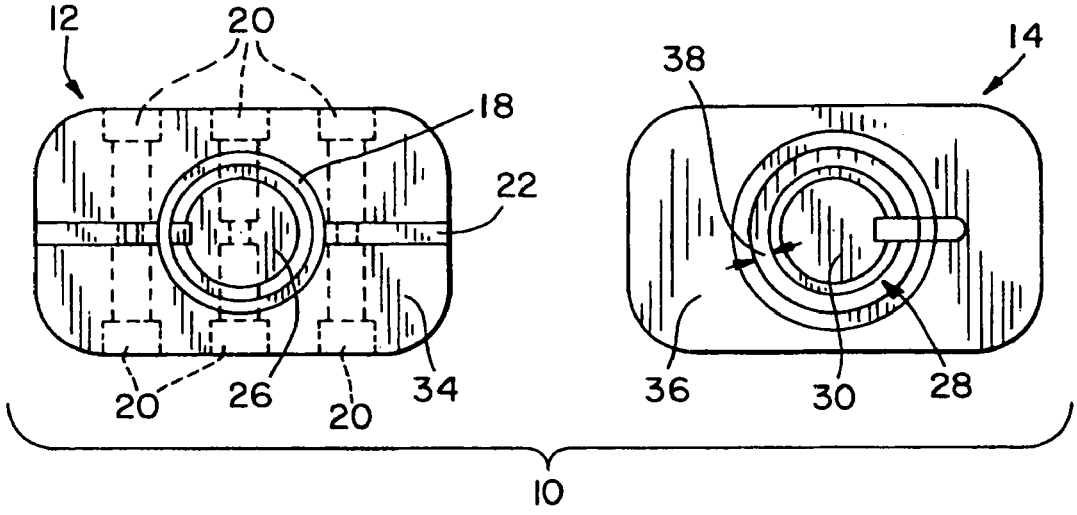
FIG. 3 illustratively shows a front view of a cap and key of a key assembly.

FIG. 1 is an illustrative side view of a key assembly 10 having a key 12 and a cap 14. Key 12 includes grip 16, key body 18, and key head 22 (shown in FIG. 3). Fasteners 20 fasten grip 16 to key head 22. Key body 18 is illustratively shown to have a circular cross-section with a flange, as shown in FIG. 3. It is appreciated that key body 18 may be formed in various shapes for various uses, such as automobile ignitions, for example. Key body 18 has magnet 26 located therein.

Cap or protective shealth 14 is illustratively shown to include opening 28, with magnet 30 located therein. Opening 28 is formed to receive key body 18. Opening 28 is also formed to allow magnets 26 and 30 to interact when key body 18 is disposed therein, bringing surfaces 34 and 36 into contact. Cap 14 includes ring 32. Ring 32 is formed to allow a key ring or other securing body to be disposed therethrough.

Figure 2:
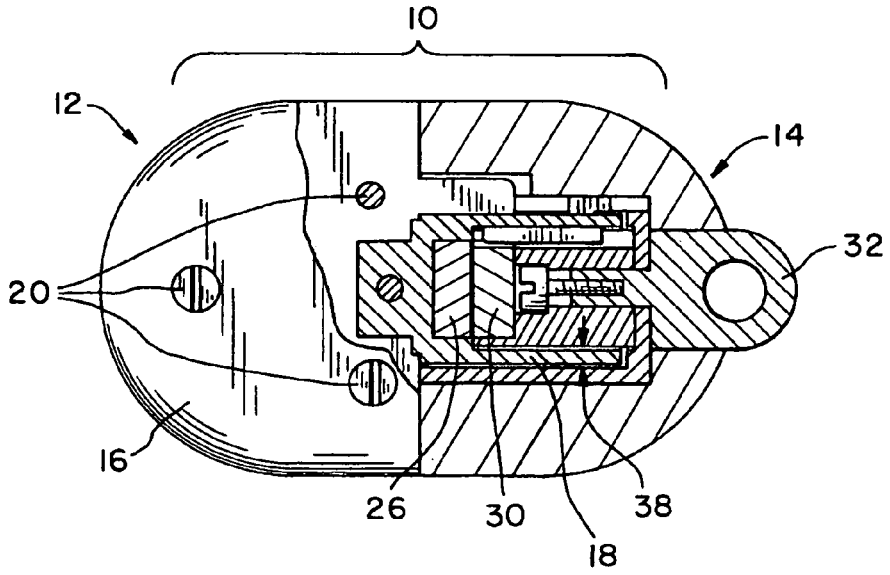
FIG. 2 illustratively shows another side view of the key assembly of FIG. 1.

FIG. 2 is an illustrative side view of cap 14 and key 12 fastened to one another with surfaces 34 and 36 in contact with one another. Magnet 30 is formed to be received by key body 18 when key body 18 is received by opening 28. Magnets 26 and 30 are then able to interact with one another to selectively fasten key 12 to cap 14. Surfaces 34 and 36 have similar cross-sections and cap 14 and grip 16 are generally symmetrical. When cap 14 and key 12 are selectively fastened to one another, key assembly 10 is uniformly shaped. Cap 14 and key 12 enclose key body 18 when selectively fastened to one another, as illustratively shown in FIG. 2.

FIG. 3 illustratively shows a front view of both key 12 and cap 14. This view shows the circular cross-section of key body 18. Opening 28 is shown to be formed for receiving the circular cross-section of key body 18. Gap 38 is dimensioned to allow key body 18 to be received by opening 28 and allow magnet 30 to be received by key body 18. This allows magnets 26 and 30 to interact, thereby bringing surfaces 34 and 36 into contact.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A key assembly comprising:

a key body configured to open and close a lock, wherein the key body has a circular cross-section;

a grip integrally formed with the key body;

a protective sheath defining an opening dimensioned to receive the key body, wherein the protective sheath is not capable of being locked by the key body;

a first magnet associated with the key body;

a second magnet associated with the protective sheath;

wherein the protective sheath and the grip are selectively fastened together through interaction of the first magnet and the second magnet; and wherein the grip has a substantially symmetrical exterior surface with respect to an exterior surface of the protective sheath when the grip is fastened to the protective sheath.

2. The assembly of claim 1, wherein the protective sheath is an integral member without any moving parts.

3. The assembly of claim 2, wherein the key assembly has an approximately elliptical cross-section along a longitudinal axis of the key assembly when the protective sheath and the grip are fastened together.

4. The assembly of claim 3, wherein the exterior surface of the protective sheath has an approximately elliptical half cross-section along a longitudinal axis of the protective sheath.

5. The assembly of claim 4, wherein the exterior surface of the grip has an approximately elliptical half cross-section along a longitudinal axis of the grip.

6. The assembly of claim 5, wherein the key body is hidden from view when the protective sheath and the grip are fastened together.

7. The assembly of claim 1, wherein an exterior surface of the key assembly has an uninterrupted exterior surface contour when the protective sheath and the grip are fastened together.

8. The assembly of claim 7, wherein the opening is shaped to prevent rotation of the key body with respect to the protective sheath.

9. The assembly of claim 8, wherein the key body includes a flange that is received in the opening to prevent rotation of the grip with respect to the protective sheath.

10. The assembly of claim 1, wherein the first magnet has a circular cross-section.

11. The assembly of claim 10, wherein the first magnet and the key body are concentric.

12. A key assembly comprising:

a key body configured to open and close a lock;

a grip integrally formed with the key body;

a protective sheath defining an opening dimensioned to receive the key body, wherein the protective sheath is an integral member without any moving parts;

a clasping mechanism configured to selectively fasten the grip and the protective sheath together;

wherein the grip has an approximately elliptical half cross-section along a longitudinal axis of the grip; and wherein the protective sheath has an approximately elliptical half cross-section along a longitudinal axis of the protective sheath.

13. The assembly of claim 12, wherein the key body is hidden from view when the protective sheath and the grip are fastened together.

14. The assembly of claim 12, wherein an exterior surface of the key assembly has a substantially uninterrupted exterior surface contour when the protective sheath and the grip are fastened together.

15. The assembly of claim 14, wherein the opening is shaped to prevent rotation of the grip with respect to the protective sheath.

16. The assembly of claim 15, wherein the key body includes a flange that is received in the opening to prevent rotation of the grip with respect to the protective sheath.

17. A key assembly comprising:

a key body configured to open and close a lock; wherein the key body has a circular cross-section;

a grip integrally formed with the key body;

a protective sheath defining an opening dimensioned to receive the key body, wherein the protective sheath is not capable of being locked by the key body and includes no moving parts;

a first magnet associated with the key body;

a second magnet associated with the protective sheath;

wherein the protective sheath and the grip are selectively fastened together through interaction of the first magnet and the second magnet;

wherein the key body is hidden from view when the protective sheath and the grip are fastened together; and wherein the key assembly has an approximately elliptical cross-section along a longitudinal axis of the key assembly when the protective sheath and the grip are fastened together.

* * * * *

UNITED STATES PATENT AND TRADEMARK OFFICE

CERTIFICATE OF CORRECTION

PATENT NO. : 7,181,939 B2
APPLICATION NO. : 10/915859
DATED : August 11, 2004
INVENTOR(S) : Anderson It is certified that error appears in the above-identified patent and that said Letters Patent is hereby corrected as shown below:

ON THE TITLE PAGE ITEM (76) PLEASE DELETE MIKE T. ANDERSEN AND REPLACE WITH MICHARL T. ANDERSEN.

Signed and Sealed this

Seventh Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,181,939 B2
APPLICATION NO. : 10/915859
DATED : February 27, 2007
INVENTOR(S) : Andersen It is certified that error appears in the above-identified patent and that said Letters Patent is hereby corrected as shown below:

ON THE TITLE PAGE ITEM (76) PLEASE DELETE MIKE T. ANDERSEN AND REPLACE WITH MICHAEL T. ANDERSEN.

This certificate supersedes Certificate of Correction issued August 7, 2007.

Signed and Sealed this

Fourth Day of September, 2007

JON W. DUDAS
*Director of the United States Patent and Trademark Office*